US008256620B2

(12) United States Patent
Kiessner et al.

(10) Patent No.: US 8,256,620 B2
(45) Date of Patent: Sep. 4, 2012

(54) BOX TEMPLATE WITH INTEGRATED CORNER PROTECTORS

(75) Inventors: Hanko Kiessner, Salt Lake City, UT (US); Ryan Osterhout, West Haven, UT (US)

(73) Assignee: Packsize LLC, Salt Lake City, UT (US)

( * ) Notice: Subject to any disclaimer, the term of this patent is extended or adjusted under 35 U.S.C. 154(b) by 131 days.

(21) Appl. No.: 12/648,211

(22) Filed: Dec. 28, 2009

(65) Prior Publication Data

US 2010/0155290 A1 Jun. 24, 2010

Related U.S. Application Data

(63) Continuation-in-part of application No. PCT/US2009/054147, filed on Aug. 18, 2009.

(60) Provisional application No. 61/089,991, filed on Aug. 19, 2008.

(51) Int. Cl.
*B65D 85/30* (2006.01)

(52) U.S. Cl. ..... 206/586; 206/453; 229/179; 229/191; 229/918

(58) Field of Classification Search ..... 206/453, 206/521, 586, 591, 592; 229/170, 177–179, 229/190, 191, 186, 918
See application file for complete search history.

(56) References Cited

U.S. PATENT DOCUMENTS

| | | | |
|---|---|---|---|
| 1,200,522 | A | 10/1916 | Richardson |
| 1,234,917 | A | 7/1917 | McClay |
| 1,703,042 | A | 3/1923 | Kondolf |
| 1,722,422 | A | 7/1928 | Johnson |
| 2,185,544 | A | 8/1933 | Darragh |
| 2,277,717 | A | 3/1942 | Sackett |
| 2,295,141 | A | 9/1942 | Van Wingen |
| 2,399,537 | A | 5/1944 | Belden |
| 2,832,270 | A | 2/1955 | Pierce, Jr. |
| 2,857,090 | A | 10/1958 | Fallert |
| 3,003,676 | A | 10/1961 | De Nola |

(Continued)

FOREIGN PATENT DOCUMENTS

| | | |
|---|---|---|
| EP | 0621194 | 10/1994 |

(Continued)

OTHER PUBLICATIONS

International Search Report and Written Opinion from PCT/US2010/031017 dated Jun. 28, 2010.

(Continued)

*Primary Examiner* — Luan K Bui
(74) *Attorney, Agent, or Firm* — Workman Nydegger

(57) ABSTRACT

A box template formed of a sheet of material defines a foldable box having at least four side surfaces, a first end surface, and a second end surface. The box template also includes corner protector sections integrally formed with the foldable box. The corner protector sections are configured to be folded to protect an object placed inside the foldable box. The first end surface and second end surface may each include at least two surfaces that are integrally formed with, and connected to, two of the side surfaces. The corner protector sections may be integrally formed with, and connected to, the other two sides of the four side surfaces. The corner protector sections are configured with a plurality of identifiable sections that may be folded in order to create corner protectors. Four corner protector sections may be integrally formed with the foldable box so as to define eight corner protectors.

27 Claims, 10 Drawing Sheets

U.S. PATENT DOCUMENTS

| | | | | |
|---|---|---|---|---|
| 3,143,937 | A | 8/1964 | Martin | |
| 3,158,307 | A | 11/1964 | Mayer | |
| 3,221,973 | A | 12/1965 | Kalbrener | |
| 3,268,147 | A * | 8/1966 | Karl-Hans Burger | 229/191 |
| 3,443,684 | A | 5/1969 | Taylor | |
| 3,482,759 | A | 12/1969 | Ortiz | |
| 3,586,233 | A | 6/1971 | McCulloch | |
| 3,690,222 | A | 9/1972 | Schroeder | |
| 3,832,826 | A | 9/1974 | Ullman | |
| 3,843,038 | A | 10/1974 | Sax | |
| 3,948,152 | A | 4/1976 | Nolan et al. | |
| 3,957,196 | A | 5/1976 | Kellerman | |
| 4,027,817 | A | 6/1977 | Fremion | |
| 4,094,451 | A | 6/1978 | Wescoat | |
| RE30,325 | E | 7/1980 | Waldbauer | |
| 4,211,356 | A * | 7/1980 | Tsuchiya et al. | 206/586 |
| 4,215,522 | A | 8/1980 | Clift et al. | |
| 4,264,200 | A | 4/1981 | Tickner et al. | |
| 4,399,915 | A | 8/1983 | Sorenson | |
| 4,522,016 | A | 6/1985 | Dirico | |
| 4,608,038 | A | 8/1986 | Virta et al. | |
| 4,838,468 | A | 6/1989 | Lesse | |
| 4,972,954 | A | 11/1990 | Dickie | |
| 5,058,872 | A | 10/1991 | Gladow | |
| 5,115,625 | A | 5/1992 | Barbulesco et al. | |
| 5,372,259 | A * | 12/1994 | Suzuki et al. | 206/586 |
| 5,374,326 | A | 12/1994 | Marchetti | |
| 5,823,352 | A | 10/1998 | Mena et al. | |
| 5,836,498 | A | 11/1998 | Turek | |
| 5,975,303 | A | 11/1999 | Morell | |
| 5,996,885 | A * | 12/1999 | Chu | 229/179 |
| 6,012,587 | A | 1/2000 | McCullough | |
| 6,016,904 | A | 1/2000 | Hammock et al. | |
| 6,471,124 | B1 * | 10/2002 | Tedeschi, Jr. | 229/179 |
| 6,675,970 | B1 * | 1/2004 | Nemoto | 206/521 |
| 7,100,811 | B2 | 9/2006 | Pettersson et al. | |
| 7,121,453 | B2 * | 10/2006 | Nass | 229/177 |
| 7,726,489 | B2 * | 6/2010 | Li | 206/586 |
| 7,913,896 | B2 | 3/2011 | Reinkensmeyer | |
| 2002/0011171 | A1 | 1/2002 | Usui | |
| 2005/0121356 | A1 | 6/2005 | Wisecarver | |
| 2005/0211600 | A1 * | 9/2005 | Saito | 206/586 |
| 2007/0145664 | A1 | 6/2007 | Sardella | |
| 2007/0199648 | A1 | 8/2007 | Hulverscheidt, Jr. | |
| 2011/0186618 | A1 | 8/2011 | Keissner | |
| 2011/0272312 | A1 | 11/2011 | Kramer | |

FOREIGN PATENT DOCUMENTS

| | | |
|---|---|---|
| EP | 1211192 | 6/2002 |
| EP | 1870341 | 12/2007 |
| FR | 2813584 | 3/2002 |
| GB | 2079802 | 1/1982 |
| JP | 11-157569 | 6/1999 |
| KR | 20-0251839 | 11/2001 |

OTHER PUBLICATIONS

Notice of Allowability from U.S. Appl. No. 11/942,355 dated Sep. 10, 2010.

International Search Report and Written Opinion from PCT/US2009/049602 dated Aug. 25, 2009.

International Search Report and Written Opinion from PCT/US2009/054147 dated Aug. 18, 2009.

International Search Report and Written Opinion from PCT/US2009/065552 dated Nov. 23, 2009.

International Search Report and Written Opinion from PCT/US2009/064477 dated Nov. 13, 2009.

International Search Report and Written Opinion from PCT/US2010/022983 dated Feb. 3, 2010.

International Search Report and Written Opinion from PCT/US2009/064248 dated Dec. 29, 2009.

Office Action dated Jun. 17, 2009 from U.S. Appl. No. 11/942,355.

Office Action dated Mar. 16, 2010 from U.S. Appl. No. 11/942,355.

WebIndia123 "Box Making—Square Shaped Box", 2 pages, http://www.webindia123.com/craft/asp/craft.asp?c_id=166, Copyright 2000.

Instructables, "Build a Cardboard Box", http://www.instructables.com/id/Build-A-Cardboard-Box/, available at least as early as Jan. 1, 2008, 4 pages.

Custom Packaging Options, Inc. "Custom Corrugated Cardboard Boxes", http://packaging.got-boxes.com/category/custom-corrugated-cardboard-Boxes-3, 3 pages.

eHow.com "How to Make Custom Cardboard Box Sizes", 3 pages, http://www.ehow.com/how_5656898_make-custom-cardboard-box-Sizes.html, date unknown.

Ponoko, "Large Cardboard Box—No Glue", http://www.ponoko.com/design-your-own/products/large-cardboard-box-no-glue-6102, Jul. 20, 2011, 5 pages.

Custom Packaging Options, Inc. "Custom Corrugated Cardboard Boxes", http://packaging.got-boxes.com/category/custom-corrugated-cardboard-Boxes-3 , 3 pages.

International Search Report from EP 09808706 dated Feb. 16, 2012 (Copy Attached).

* cited by examiner

BOX TEMPLATE WITH INTEGRATED CORNER PROTECTORS

CROSS-REFERENCE TO RELATED APPLICATIONS

This is a continuation-in-part application and claims priority to and the benefit of PCT Patent Application No. PCT/US09/54147, filed 18 Aug. 2009, entitled BOX TEMPLATE WITH INTEGRATED CORNER PROTECTORS, which claims priority to and the benefit of U.S. Provisional Patent Application No. 61/089,991, filed 19 Aug. 2008, entitled BOX TEMPLATE WITH INTEGRAL CORNER PROTECTORS, each of which is incorporated herein by reference in its entirety.

BACKGROUND OF THE INVENTION

1. The Field of the Invention

Exemplary embodiments of the invention relate to packaging, and more particularly to the packaging of items within a box. Still more particularly, embodiments relate to packaging of an item within a box, with the box having a template formed to provide integrated corner protectors and/or spacers to protect the packaged item.

2. The Related Technology

In many industries, packaging materials are used to deliver products to clients. Generally speaking, the materials to be delivered are placed directly in a box. Such boxes may, of course, be of virtually any size and configuration. It may be that the product is placed directly inside the box without any additional protection. In other cases there may be some additional protection or cushioning provided. For instance, foam peanuts, bags of air, bubble-wrap, and the like may be used to protect a fragile or other product.

When an item is placed directly inside of a box, care is often taken to dimension the box so that the item fits snugly within the box. Such may be desirable to prevent excessive movement of the item and, consequently, reduce the shaking or movement of the item therein. To ensure a tight fit, various materials are often placed around the item. For instance, Styrofoam sheets of various sizes may be placed along the sides of the item to cause a snug fit with the sides of the box.

During handling (e.g., transit) the box may become damaged. If the damage is sufficiently severe, the item inside the box may also become damaged. During such handling, the corners of a box, and thus the corners of the item in the box, are particularly vulnerable to damage. Accordingly, companies shipping a product will often place additional protection within the corners of the box. For instance, as shown in FIGS. 1 and 2, various types of corner protectors may be used.

In each instance, corner protectors are formed of a separate material (e.g., Styrofoam, cardboard, etc.) and such protectors are placed in the corners of the box. Specifically, the packaged item abuts the internal sides of such protectors, and the internal sides of the box are positioned adjacent the exterior sides of the protector. While such corner protectors are useful in the protection of an item packaged within a box, they also require the purchase of additional materials. Some companies may, therefore, forego the use of such corner protectors in order to reduce cost. Additionally, the use of such protectors will require some separate storage apart from the boxes themselves, thereby increasing the space requirement necessary for the storage of all shipping and/or packaging supplies.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

Exemplary embodiments of the invention relate to articles for the packaging of items within boxes. Still more particularly, embodiments relate to packaging of items within boxes, which boxes are formed from a template that includes corner protectors integrated with the sheet used to form the box template.

According to one embodiment, a box template having at least one integrated corner protector is disclosed. The box template, according to the present invention, includes a foldable carton having at least four side surfaces and at least one end flap linked to at least one of the side surfaces, wherein a horizontal crease separates the at least one end flap from the at least one side surface. The at least one end flap is divided into a first section, a second section, and a third section by a series of horizontal cuts and/or creases. The third section is further separated into at least six tabs by a series of longitudinal cuts and creases, wherein the at least six tabs can be folded along the creases to form a first corner protector and a second corner protector.

In another embodiment, a foldable box is disclosed. The foldable box includes at least four side surfaces, a first end surface formed from two major flaps, and a second end surface formed from two major flaps. The foldable box also includes multiple minor flaps integrally formed therein. According to the present embodiment, each minor flap is configured to be folded into one or more corner protectors. The one or more corner protectors are configured to protect an item placed inside the foldable box.

A box template or a foldable box may be cut from a sheet of cardboard or a similar packaging material to form a foldable box having at least four side surfaces, a first end surface, and a second end surface. The box template may also include corner protector sections integrally formed with the foldable box and configured to be folded to protect an item placed inside the foldable box. For instance, the first end surface and second end surface may each include at least two surfaces that are integrally formed with, and connected to, two of the side surfaces. The corner protector sections may be integrally formed with, and connected to, one or both of the other two sides of the four side surfaces. Each of the corner protector sections may be configured to be folded into two corner protectors. For example, the box template may include two, four, six, or eight corner protectors.

More particularly, the box template may be formed from a sheet of material (e.g., cardboard) by making various cuts and/or forming various creases in the sheet of material. For example, cuts and creases may be formed to define twelve rectangular sections that form the sides, first end, and second end of the foldable box, as well as one or more integrated corner protector sections. In addition to the twelve rectangular sections, a glue flap may optionally be formed in the box template to facilitate assembly of the box template into a box. The twelve rectangular sections can be arranged in a three-row, four-column pattern. The four rectangles that define the middle row can be folded to form the sides of the box. Similarly, the rectangles in the first end and second end rows can be cut to form minor and major flaps, some of which can be used to form the first end and second end of the box. Furthermore, one or more of the minor flaps can be creased and cut to form the one or more integrated corner protector sections.

The corner protector sections themselves may be formed on one, two, three, or four minor flaps, each of which may include two corner protectors. Each corner protector may be formed from three rectangular tabs (e.g., a first tab, a second tab, and a third tab) that are arranged in a two-by-one pattern. As mentioned above, the minor flaps may be divided into a first section, a second section, and a third section by a series of horizontal cuts and creases. The third section may be further separated into at least six tabs by a series of longitudinal cuts and creases, wherein the at least six tabs can be folded along the creases to form a first corner protector and a second corner protector. A first corner protector on a minor flap may, for example, be formed by folding the second section of the minor flap over the first section. The first corner protector may be further formed by folding the second tab under the first tab to form a first stack such that the third tab extends away from the first stack. Alternatively, the corner protector may be further formed by folding the second tab over the first tab to form a stack such that the third tab extends away from the stack. The second corner protector on the minor flap is typically a mirror image of the first corner protector.

In one embodiment, one or more of the minor flaps of the box template can further include a seventh tab that is disposed between a first set of three tabs configured for forming a first corner protector and a second set of three tabs configured for forming a second corner protector. In one aspect, the box template can further include a cut portion in the crease between the side panel and the minor flap configured for positioning the seventh tab therethrough.

Accordingly, the first and second corner protectors can be formed by folding the second section over the first section. The first corner protector is further formed by folding the second tab under the first tab to form a first stack such that the third tab extends away from the first stack, the second corner protector is further formed by folding the fifth tab under the sixth tab to form a second stack such that the fourth tab extends away from the second stack, and the seventh tab can be inserted through cut portion so as to secure the first and second corner protectors in a folded position. This can allow one worker to assemble all of the corner protectors on the box template prior to placing an item on the box template and folding the box template around the item.

Each of the one or more corner protector sections integrally formed with the box template can be folded and inserted into the box created with the box template to provide increased protection to items packaged within the box. The corner protectors can provide uniform protection to the corners of an item packaged within the box. Additionally, the corner protector sections can be formed and the box template can be folded around an item to be packaged. Moreover, the corner protectors can be integrally formed with the box template in such a manner that no additional material is used to form the box with integrated corner protectors compared to a similar type box without corner protectors.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages will be set forth in the description which follows, and in part will be obvious from the description, or may be learned by the practice of the teachings herein. Features and advantages of the invention may be realized and obtained by means of the instruments and combinations particularly pointed out in the appended claims. Features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

The embodiments described herein extend to methods, devices, systems, assemblies, and apparatus for packaging objects. Such are configured to, for example, allow corner protectors to be inserted around an item placed within a box, without requiring a separate corner protector to be installed or procured.

Reference will now be made to the drawings to describe various aspects of exemplary embodiments of the invention. It is understood that the drawings are diagrammatic and schematic representations of such exemplary embodiments, and are not limiting of the present invention, nor are any particular elements to be considered essential for all embodiments or that elements be assembled or manufactured in any particular order or manner. No inference should therefore be drawn from the drawings as to the necessity of any element. In the following description, numerous specific details are set forth in order to provide a thorough understanding of the present invention. It will be obvious, however, to one of ordinary skill in the art that the present invention may be practiced without these specific details. In other cases, well known aspects of packaging materials, boxes, and general manufacturing techniques are not described in detail herein in order to avoid unnecessarily obscuring the novel aspects of the present invention.

FIGS. 3-7B and the following discussion are intended to provide a brief, general description of exemplary box templates which can be used according to aspects of the present invention, and which can include corner protectors which are integrated with the box templates. While a box template with integrated corner protectors is described below with respect to cardboard boxes, this is but one single example, and embodiments of the invention may be implemented with boxes formed of other types of materials, and with boxes of varying sizes and configurations. Accordingly, throughout the specification and claims, the term "box" is intended to apply broadly to any type of packaging container or material used to enclose objects.

As used herein, the terms "end flap" and "minor flap" are used more-or-less interchangeably to refer to an interior end flap section that forms part of the interior end section of a folded box or a foldable carton.

Figure 1:
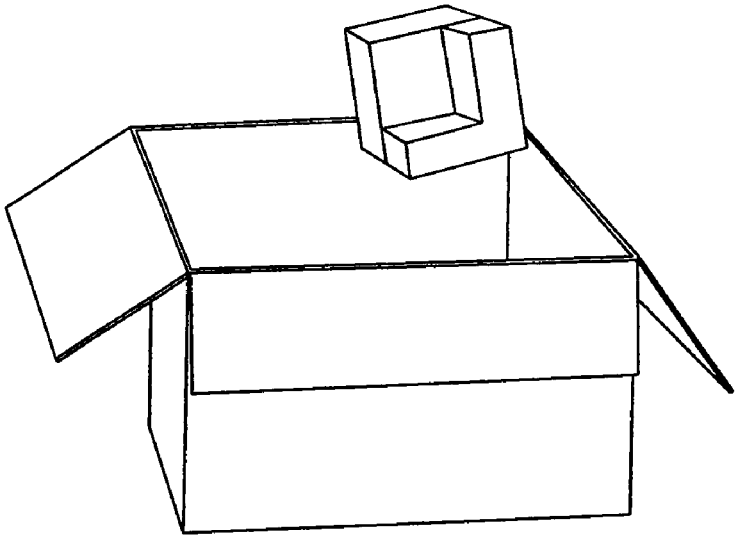
FIG. 1 (Prior Art)
FIG. 1 illustrates an example external corner protector that is separate from the boxes with which it is used, and which is made of a polymeric material.
Figure 2:
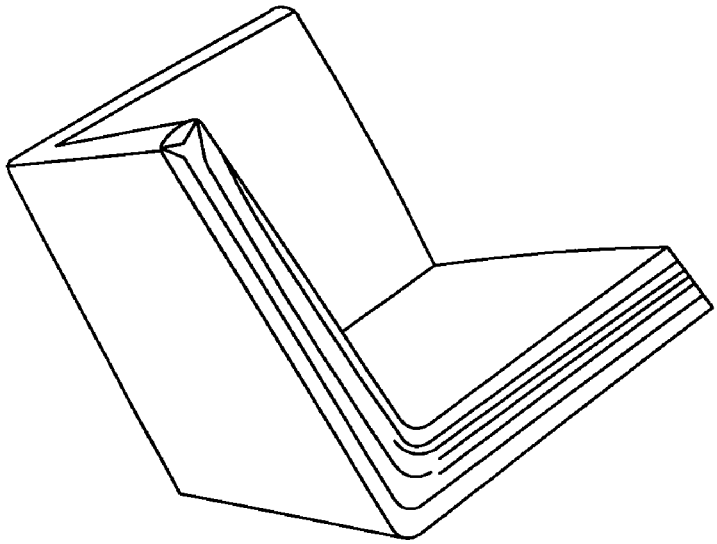
FIG. 2 (Prior Art)
FIG. 2 illustrates other external corner protectors which are separate from the boxes with which they are used, and which are made of cardboard.
Figure 3:
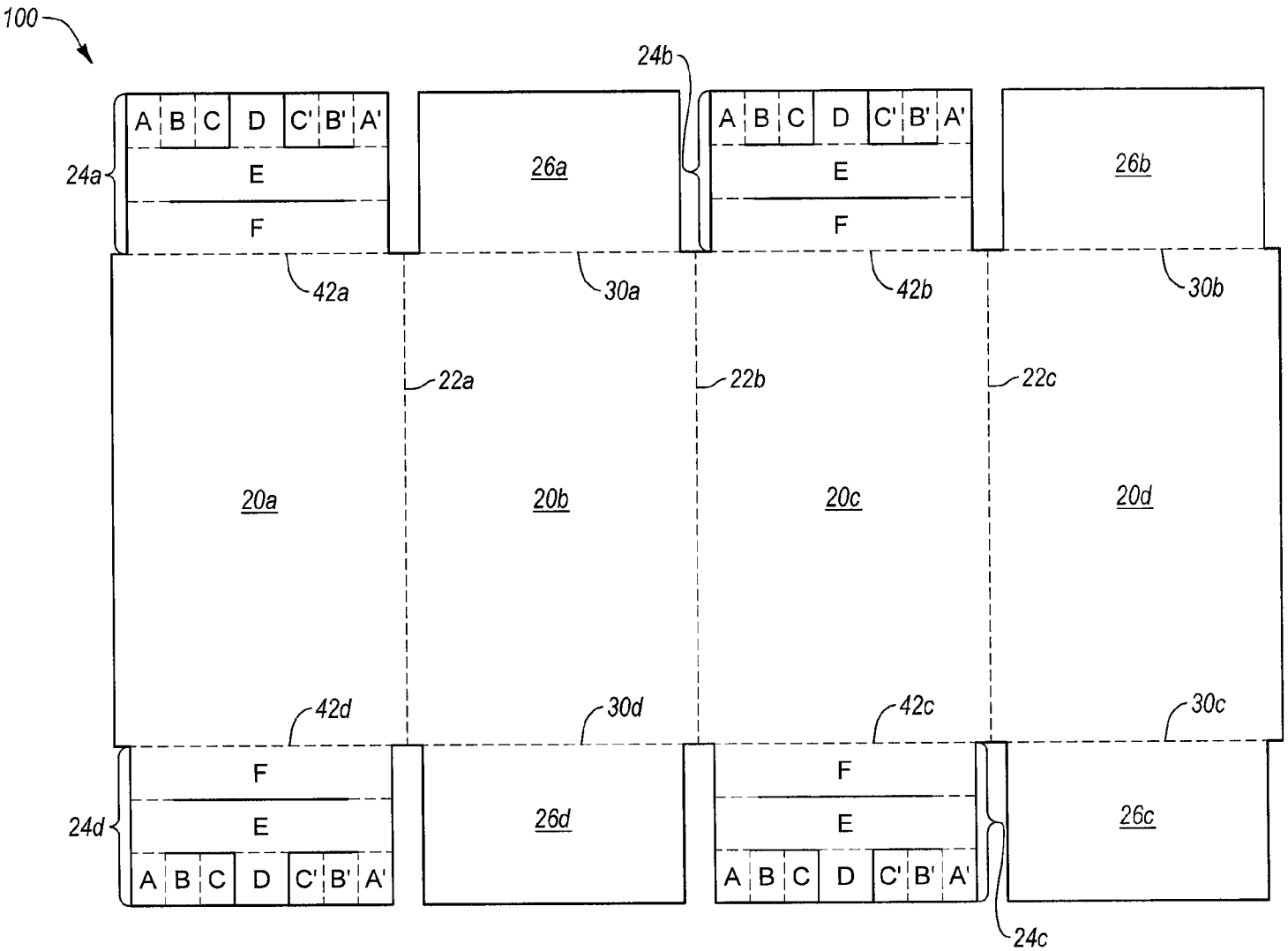
FIG. 3 illustrates one embodiment a box template for forming a box having four sides, a first end, and a second end, along with four integrated corner protector sections that form eight corner protectors.

FIG. 3 illustrates an example box template 100 that can be formed from a rectangular sheet of cardboard or other material. The box template 100 includes sections 20*a*-20*d* that are configured for forming the sides of a box and sections 26*a*-26*d* that are configured to form a first end and a second end of the box. In contrast sections 24*a*-24*d* are used to form corner protectors for the corners of the box formed by the illustrated box template 100. It will be understood that not all of sections 24*a*-24*d* are required to be formable into corner protectors. Rather, one or more of sections 24*a*-24*d* can be configured to form corner protectors, while the remaining sections of sections 24*a*-24*d* can be used to form interior, minor flaps that form the first end and/or second end of the box.

Figure 4:
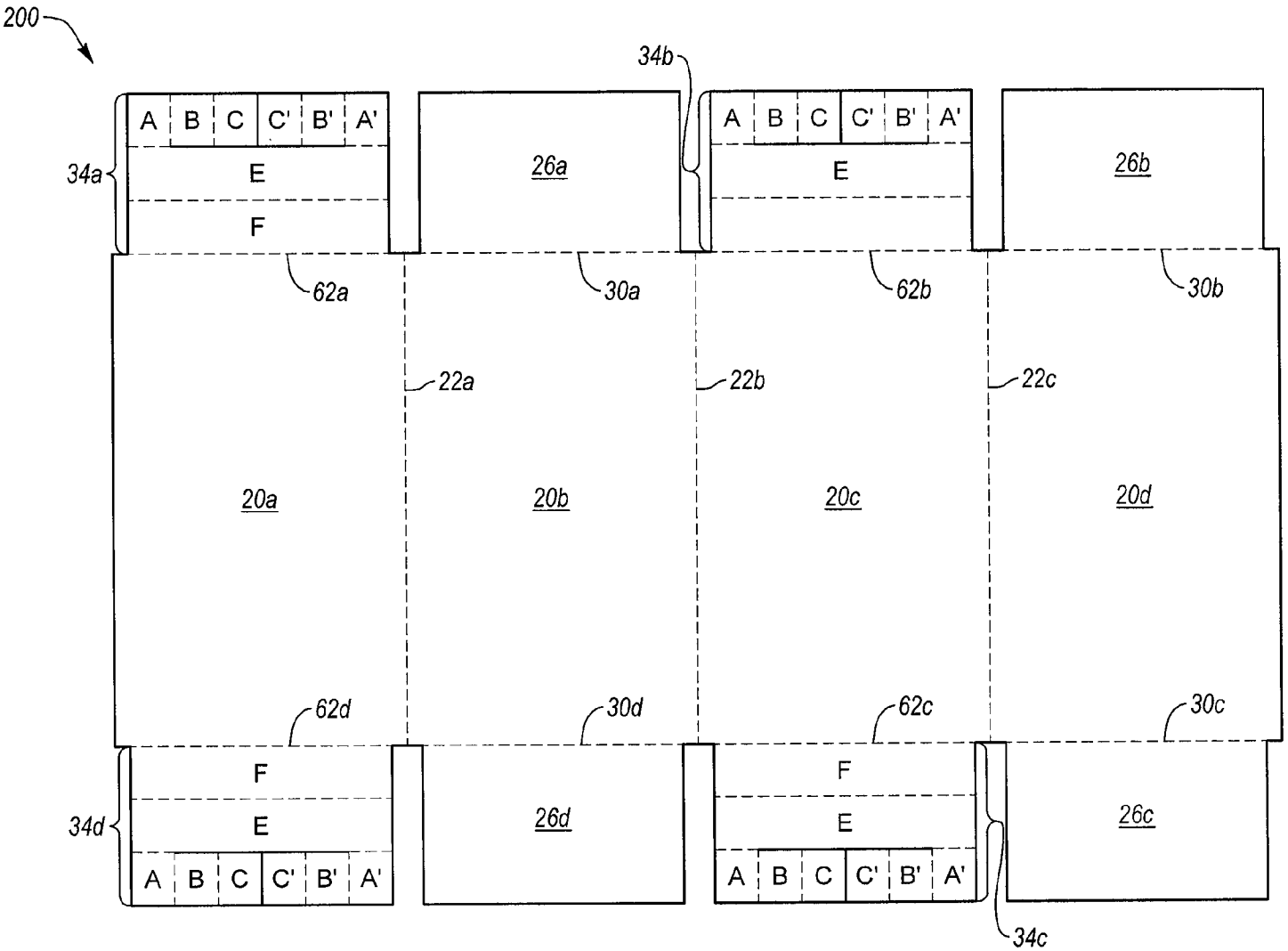
FIG. 4 illustrates another embodiment a box template for forming a box having four sides, a first end, and a second end, along with four integrated corner protector sections that form eight corner protectors.

FIG. 4 illustrates an alternative example of a box template 200 that can be formed from a rectangular sheet of cardboard or other material. The box template 200 includes sections 20*a*-20*d* that are configured for forming the sides of a box and sections 26*a*-26*d* that are configured to form the first end and the second end of the box. In contrast sections 34*a*-34*d* are used to form corner protectors for the corners of the box formed by the illustrated box template 200. As with box template 100, it will be understood that not all of sections 34*a*-34*d* are required to be formable into corner protectors. Rather, one or more of sections 34*a*-34*d* can be configured to form corner protectors, while the remaining sections of sections 34*a*-34*d* can be used to form interior, minor flaps that form the first end and/or second end of the box.

As illustrated in FIGS. 3 and 4, the various sections, while integrally formed of a common sheet of material, are separately identifiable as they are separated by a series of lines. In the illustrated embodiments of FIGS. 3-7B, dashed lines are used to represent crease lines. In contrast, solid lines between sections illustrate cut lines.

To use box template 100 or 200 to form a box to package an item, corner protectors may be formed at one or more of sections 24*a*-24*d* or 34*a*-34*d* by dividing and folding one or more of sections 24*a*-24*d* or 34*a*-34*d* along the cut and crease lines. An item to be packaged may then be placed on one of the sections (e.g., section 20*a*) of the template 100 or 200 and the box can be formed or folded around the item. With the item to be packaged disposed on one of the side sections 20*a*-20*d*, the box template 100 or 200 is folded along the illustrated crease lines 22*a*-22*c* between sections 20*a*-20*d* to form the sides of the box.

Section 20*a* may then be secured to section 20*d* to form a box shape. For example, section 20*a* may be attached to section 20*d* by way of one or more glue flaps that are integrally formed with, and/or connected to, one or both of sections 20*a* and 20*d*. In another example, section 20*a* may be attached to section 20*d* by way of length of tape or another adhesive strip to form a manufacturer's joint. Alternatively, section 20*a* may be secured in proximity to section 20*d* without the aid of a glue flap or a manufacturer's joint, such as by securing the sides of the box around the packaged item with straps or other binding strips.

As sections 20*a*-20*d* are folded to form the sides of the box, sections 24*a*-24*d* or 34*a*-34*d*, which can be folded to form the corner protectors, are folded in along crease lines 42*a*-42*d* or 62*a*-62*d* and the integrated corner protectors are placed around the item to secure the item and suspend it away from the sides of the box. Sections 26*a* and 26*b* are then folded along crease lines 30*a* and 30*b* to form the first end of the box, while sections 26*c* and 26*d* are folded along crease lines 30*c* and 30*d* to form the second end of the box. The flaps forming the first end and the second end of the box may be secured with tape or straps to maintain the box in a closed position. The tape or straps used to hold the first and second ends of the box closed can be the same as, or different from the straps used to hold the sides of the box around the packaged item.

As will be appreciated, a box template 100 such as that illustrated in FIG. 3 and/or a box template 200 such as that illustrated in FIG. 4 can be made to form a box of substantially any size. For example, according to one embodiment, the box that is formable from the illustrated templates 100 and 200 is approximately 20"×20"×20". To form a box of such a size, for example, sections 20*a*-20*d* may each be squares that are approximately 20"×20". In some cases, to account for the space of creases, the sections may be made slightly larger so that the interior of the box is 20"×20"×20".

As with sections 20*a*-20*d*, sections 26*a*-26*d* may also have any suitable size. For example, such sections may be integrally formed with corresponding side sections (e.g., section 26*a* is integrally connected to section 20*b*), and have a corresponding width (e.g., section 20*b* and section 26*a* may each be about 20" wide). The height of sections 26*a*-26*d* may be adjusted as desired. For instance, the height of sections 26*a*-26*d* may be approximately half that of the side sections 26*a*-26*d* or another suitable dimension. Typically, the height of sections 26*a*-26*d* can range from being generally equal to about half the width of sections 20*a* and 20*c* up to about the width of sections 20*a* and 20*c*.

The remaining four sections 24*a*-24*d* and 34*a*-34*d* are, in the illustrated embodiment, configured to be folded and positioned inside the box, such that when the box is formed from the illustrated template 100 or 200, they will be positioned inside the side walls formed by sections 20*a*-20*d*, and inside the first and second ends formed by sections 26*a*-26*d*. More particularly, these minor flap sections 24*a*-24*d* and 34*a*-34*d* can be folded to form up to eight corner protectors that can fit at the four corners of the first end and the four corners of the second end of the box formed by the illustrated box templates 100 and 200.

As will be appreciated, the minor flap sections 24*a*-24*d* and 34*a*-34*d* may have a size generally corresponding to the size of the first end and the second end sections 26*a*-26*d*, although this is not always necessary. For instance, the widths of the minor flap sections 24*a*-24*d* and 34*a*-34*d* can be generally equal to the width of side sections 20*a* and 20*b*. The heights of minor flap sections 24*a*-24*d* and 34*a*-34*d* are typically, but not necessarily, generally equal to the heights of the first end and the second end sections 26*a*-26*d*. In one embodiment, the heights of the minor flap sections 24*a*-24*d* and 34*a*-34*d* are generally equal to half the width of side sections 20*b* and 20*d*. In other embodiments, the heights of the minor flap sections

24*a*-24*d* and 34*a*-34*d* are generally equal to less than half the width of side sections 20*b* and 20*d*. In still other embodiments, the heights of the minor flap sections 24*a*-24*d* and 34*a*-34*d* are generally equal to the width of side sections 20*b* and 20*d*.

As noted herein, one or more the minor flap sections 24*a*-24*d* and 34*a*-34*d* can be used to form at least a portion of the first end and/or the second end of the box rather than forming corner protectors. Thus, a box template according to the present invention can include one, two, three, or four corner protector sections, such as the minor flap sections 24*a*-24*d* and 34*a*-34*d*, which can be configured to form two, four, six, or eight corner protectors, respectively.

Figure 5A:
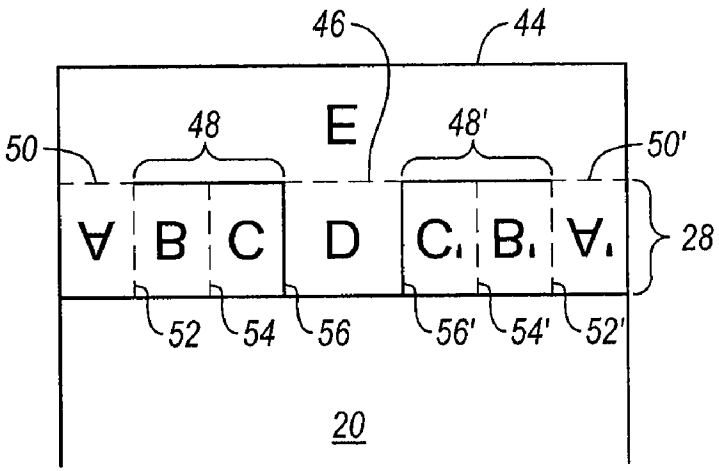
FIGS. 5A-5D illustrate exemplary steps in and views of forming corner protectors from the box template of FIG. 3.
Figure 5:
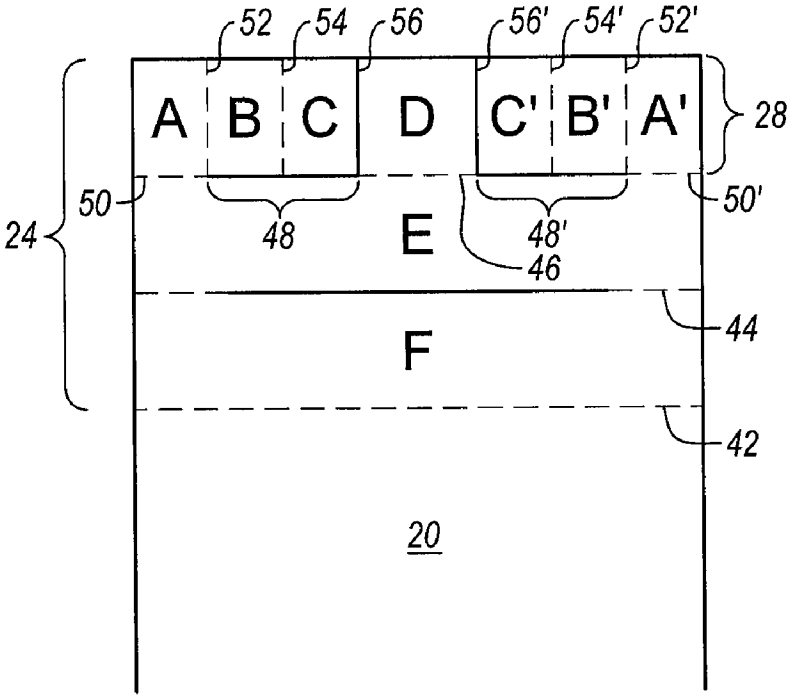
FIG. 5 illustrates an enlarged view of one of the integrated corner protector sections of FIG. 3.

Turning now to FIG. 5, an enlarged view of one of the minor flaps (e.g., minor flap 24*a*) shown in FIG. 3 is illustrated. The illustrated minor flap 24 is defined as separate from the adjacent side panel 20 by crease line 42. The minor flap 24 is further divided into three sections by a series of cuts and creases. The first section (i.e., section F) is defined by crease line 42 and crease line 44. The second section (i.e., section E) is defined by crease line 44 and the crease cut line that includes creases 50 and 50', cuts 48 and 48', and crease 46. As can be seen, crease line 44 can include a cut section (depicted by the solid line in the middle portion of crease line 44) to facilitate folding the second section E over the first section F.

The third section 28, which is separated from the second section E by creases 50 and 50', cuts 48 and 48', and crease 46, includes two pairs of three tabs, A, B, and C, and A', B', and C', and a center tab D. As will be discussed in greater detail below, tabs A, B, and C of third section 28 can be folded to form a first corner protector and tabs A', B', and C' of third section 28 can be folded to form a second, symmetrical corner protector.

The first section F has a first height and the second section E has a second height that is substantially equal to the first height. It is preferred that the height of second section E be substantially the same as the height of the first section F so that the crease cut line between section E and third section 28 (creases 50 and 50', cuts 48 and 48', and crease 46) matches up or aligns with crease line 42 when section E is folded along crease line 44 onto section F. One will appreciate, however, that the height of section E relative to section F may need to be altered slightly in order to accommodate for the thickness of the material used to form the box template so that section E matches up with crease line 42 when section E is folded over section F. In contrast, the third section 28 can have a third height that is the same or different than the height of sections E and F. Instead, the height of third section 28 can be selected according to the corner protection needs of the object to be packaged.

As illustrated, the third section 28 is divided into seven tabs. The first tab (i.e., tab A) is defined by a horizontal crease 50 between section E and the third section 28 and by a longitudinal crease 52 between tab A and the second tab (i.e., tab B). Tab B is further defined by a portion of horizontal cut 48 between section E and section 28 and by a longitudinal crease 54 between tab B and the third tab (i.e., tab C). Tab C is further defined by a portion of horizontal cut 48 between section E and section 28 and by a longitudinal cut 56 between tab C and the seventh tab (i.e., tab D). Tab D is further defined by a horizontal crease 46 between section E and section 28 and by a longitudinal cut 56' between section D and the fourth tab (i.e., tab C'). Tab C' is further defined by a portion of horizontal cut 48' between section E and section 28 and longitudinal crease 54' between tab C' and the fifth tab (i.e., tab B'). Tab B' is further defined by a portion of horizontal cut 48' between section E and section 28 and by a longitudinal crease 52' between tab B' and the sixth tab (i.e., tab A'). Tab A' is further defined by a horizontal crease 50' between section E and section 28.

In one aspect, first tab A has a first width and second tab B has a second width that is substantially equal to the first width. Likewise, sixth tab A' has a sixth width and fifth tab B' has a fifth width that is substantially equal to the sixth width. In one embodiment, the first and second widths can be substantially equal to the sixth and fifth widths or they can be different. It is preferable that first tab A and second tab B and sixth tab A' and fifth tab B' have widths that are substantially equal to one another so that the corner protectors meet up with the edges of the side panels to which they correspond when the box is folded. One will appreciate, however, that the widths of tabs A, B, A', and B' may need to be adjusted relative to one another in order to accommodate for the thickness of the material used to form the box template so that the corner protectors meet up with the edges of the side panels to which they correspond when the box is folded. In contrast, the widths of tabs C, C', and D can be substantially equal to the widths of tabs A, B, A', and B', or they can be selected more-or-less arbitrarily or according to the corner protection needs of the object to be packaged.

Turning now to FIGS. 5A-5D, an exemplary manner of folding the corner protectors of FIG. 5 is illustrated. The illustrated embodiment shows only one pair of corner protectors (i.e., tabs A-C and tabs A'-C') so as to more clearly illustrate various exemplary manners in which the corner protector can be created from tabs A-C and tabs A'-C'. FIGS. 5A-5D illustrate various exemplary folding actions that can be used to create corner protectors. In an effort to clearly illustrate the various folding actions, the orientation of the alphabetic identifiers for each of tabs and sections A-F changes as the orientation of the tabs and sections change. For instance, the alphabetic identifiers (A-F) in FIG. 5 are all oriented in an upright manner, indicating that each of the tabs and sections A-F are oriented uprightly. In FIGS. 5A-5D, the alphabetic identifiers may be inverted or otherwise oriented to illustrate the orientation of the section or tab relative to the other sections and tabs. For example, the letters A, B, C, D, A', B', C', and E in FIG. 5A are inverted to illustrate that these sections and tabs have been folded so as to view the backside of the sections and tabs denoted by A, B, C, D, A', B', C', and E relative to the view in FIG. 5.

With respect to FIG. 5, there is shown two corner protection sections (tabs A-C and tabs A'-C') that extend from section E. The two corner protection sections can be divided along the cut lines and folded along the crease lines to form first and second corner protectors. For instance, as illustrated in FIG. 5A, in a first step of forming the first and second corner protectors, section E and section 28 are folded along crease line 44 so that section E lies over section F. In a second step illustrated in FIG. 5B, the first corner protector is further formed by folding tabs B and C along crease 52 so that tab B lies under tab A to form a first stack such that tab C extends away from the first stack. Likewise, the second corner protector can be further formed by folding tabs B' and C' along crease 52' so that tab B' lies under tab A' to form a second stack such that tab C' extends away from the second stack. Alternatively, tabs B and C and/or tabs B' and C' can be folded over corresponding tab A and/or tab A' so that tabs B and/or B' lie over tabs A and/or A'.

Figure 7B:
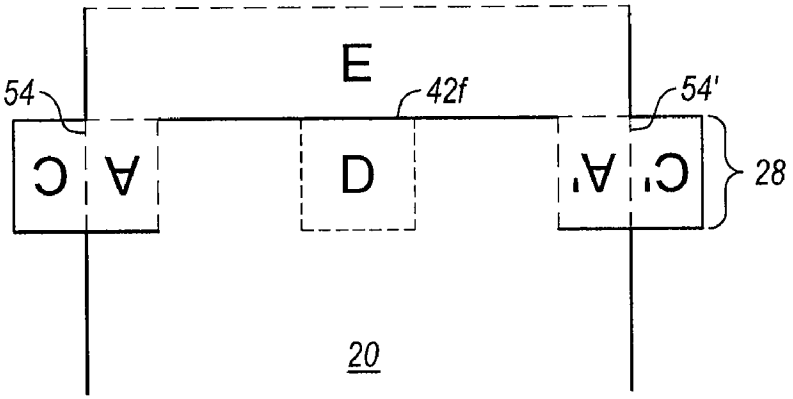
FIGS. 7A-7B illustrate an enlarged view of an alternative embodiment of one of the integrated corner protector sections of FIG. 3.
Figure 7A:
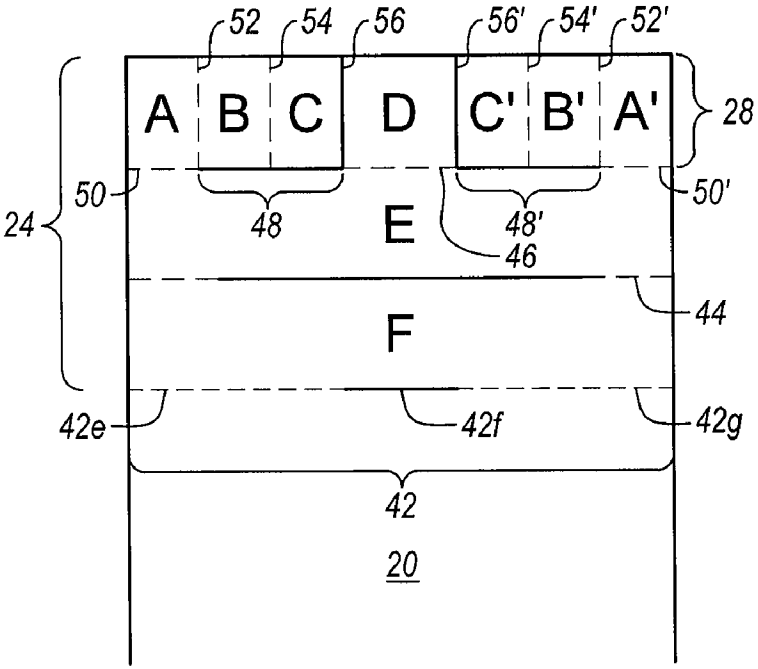

Meanwhile, tab D is folded down between the first and second corner protectors. More specifically, tab D is positioned to lie against an interior surface of side section 20. In an alternative embodiment illustrated in FIGS. 7A and 7B, tab D can be positioned through an appropriately sized cut 42*b* in crease line 42. When the corner protectors are formed as illustrated in FIG. 7B, inserting tab D through the cut portion 42*b* can act to secure the corner protectors in a folded position. This can, for example, permit a packager to assemble the corner protectors on each of the minor flaps and package up an item to be boxed without needing to be able to simultaneously reach both ends of the box to assemble and secure the corner protectors.

Figure 5B:
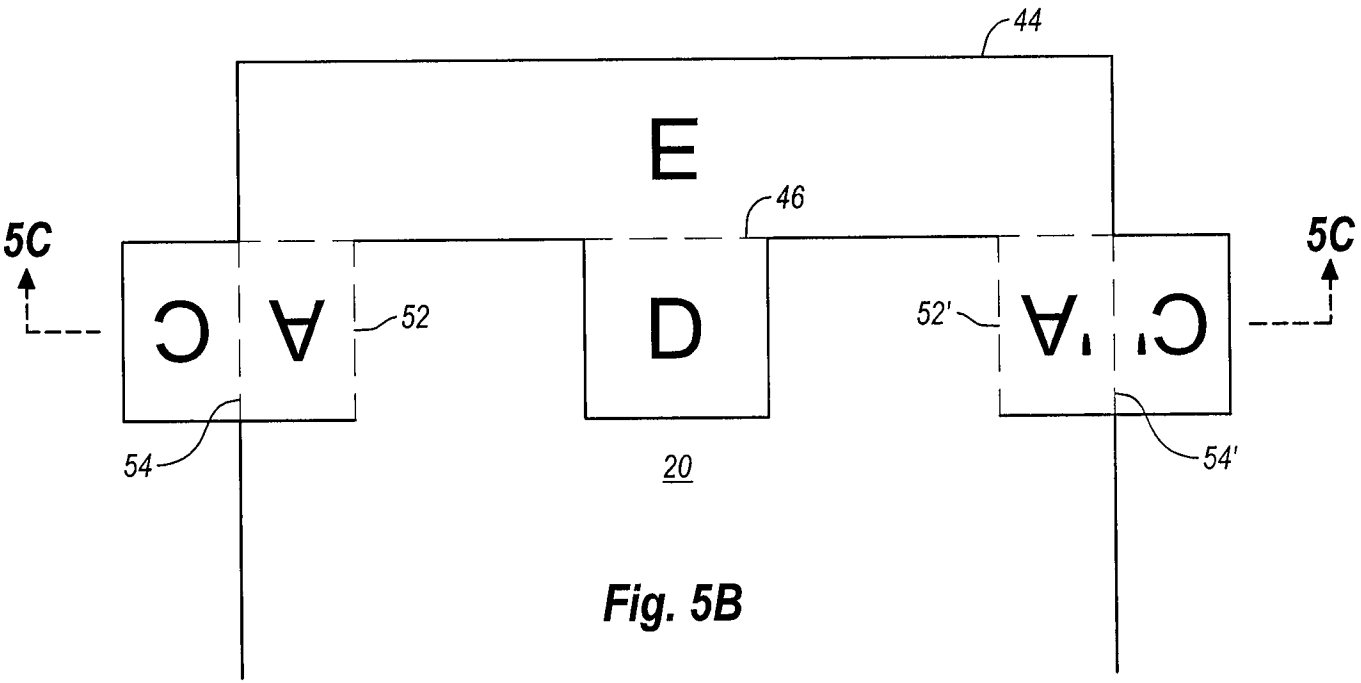
Figure 5C:
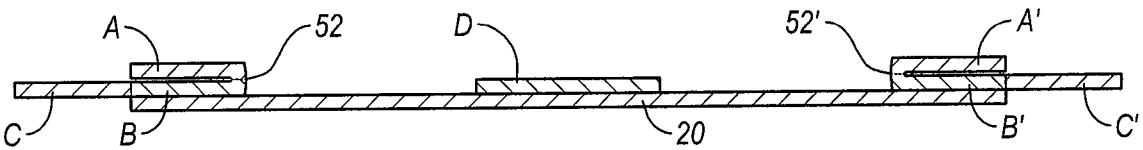

Referring back to FIG. 5C, a cut-away view of the corner protector section of FIG. 5B is illustrated. As can be seen in FIG. 5C, tab B is folded under tab A along crease line 52 to form a stack with tab C extending away from the stack. As such, the first corner protector is formed from three tabs folded in a two-by-one pattern. Likewise, tab B' is folded under tab A' along crease line 52' to form a stack with tab C' extending away from the stack. As such, the second corner protector is formed from three tabs folded in a two-by-one pattern.

Notably, this folding process enables one or more of the corner protectors to be formed before placing the item to be packaged on the box template and folding the box template around the item to form a package. In particular, once tabs B and B' have been folded under tabs A and A', as shown in FIG. 5B, the item to be packaged can be placed on top of the A/B and A'/B' stacks. Tabs C and C' can be folded up around the side of the item, and the side panels can be folded around the item. It will be understood that folding up the side panels can also cause tabs C and C' to be folded up around the sides of the item.

As can also be seen in FIG. 5C, tab D forms a double thickness of material with side panel 20 that can provide extra protection to the item packaged in the box. For example, if the box is strapped together, tab D can provide extra protection to keep the strap or straps from tearing through the box and damaging the packaged item.

Figure 5D:
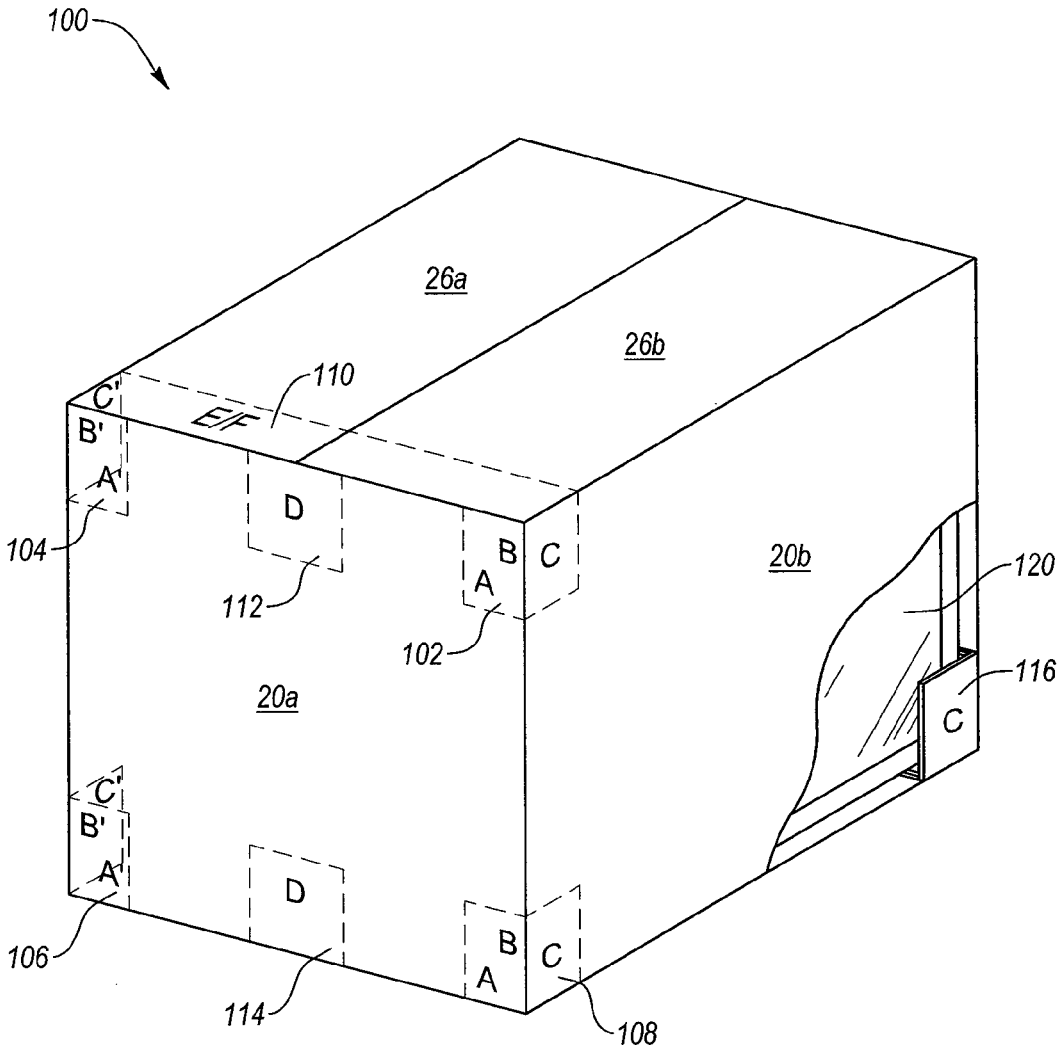

Referring now to FIG. 5D, a folded box 100 is illustrated showing side panels 20*a* and 20*b* and the first end surface formed from panels 26*a* and 26*b*. The folded box 100 is used to package article 120, which is shown in partial cut-away form. The article 110 is protected in the box by a plurality of corner protectors 102, 104, 106, and 108, which protect the sides of the article 120. The first end side of the article 120 is protected by fold 110, which includes sections E and F of the minor flap. More specifically, once the item has been placed on top of the A/B and A'/B' stacks and tabs C and C' and side panels 20*b*-20*d* are folded around the item, as described above, sections E and F can be folded (along creases 42 and 44) up around the item before panels 26*a* and 26*b* are folded to close the ends of the box. The article is also protected in the middle by the D tabs 112 and 114, which can, for example, prevent straps that are used to strap the box 100 together from tearing through the box and damaging article 120. Once the box is formed as shown in FIG. 5D, straps, tape, or other binding materials can be used to secure the side panels and end panels around the packaged item.

Figure 6A:
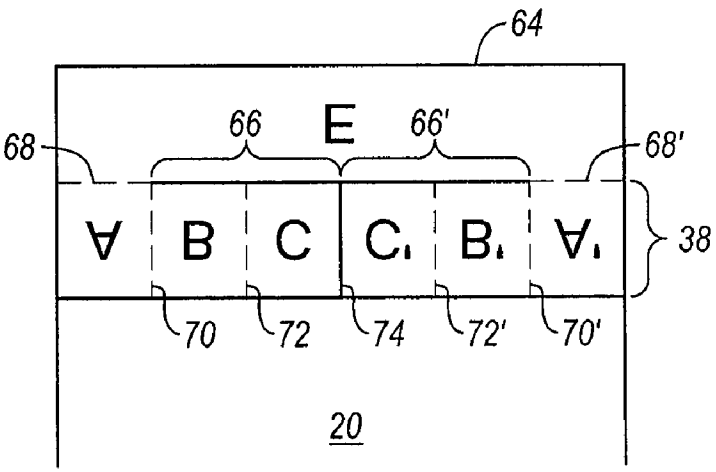
FIGS. 6A-6D illustrate exemplary steps in and views of forming corner protectors from the box template of FIG. 4.
Figure 6:
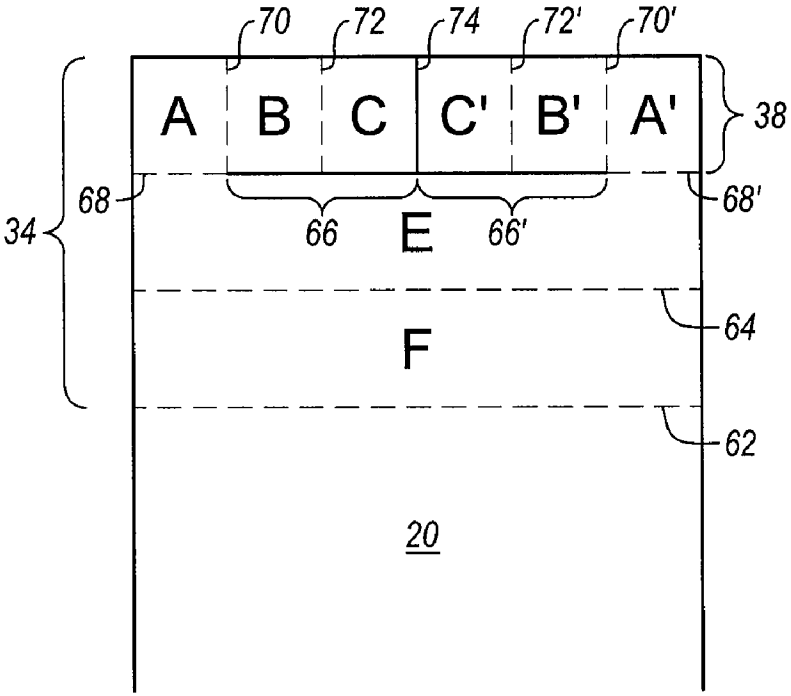
FIG. 6 illustrates an enlarged view of one of the integrated corner protector sections of FIG. 4.

Referring now to FIG. 6, an enlarged view of one of the end flaps (e.g., minor flap 34*a*) shown in FIG. 4 is illustrated. The illustrated minor flap 34 is defined as separate from the adjacent side panel by crease 62. The minor flap 34 is further divided into three sections by a series of cuts and creases. The first section (i.e., section F) is defined by crease 62 and crease 64. The second section (i.e., section E) is defined by crease 64 and the crease cut line that includes creases 68 and 68' and cuts 66 and 66'. As with crease line 44 in FIG. 5, crease 64 can include a cut section to facilitate folding section E over section F.

The third section 38, which is separated from the section E by creases 68 and 68' and cuts 66 and 66', includes two pairs of three tabs each, A, B, and C, and A', B', and C', respectively, that can be folded to form a first corner protector and a second corner protector.

As was explained in greater detail in reference to FIG. 5, the first section F has a first height and the second section E has a second height that is substantially equal to the first height. In contrast, the height of section 38 can be the substantially the same as the heights of section E and F or the height of section 38 can be selected more-or-less at random or as a function of the corner protection needs of the item to be boxed.

As illustrated, the third section 38 is divided into six tabs. The first tab (i.e., tab A) is defined by a horizontal crease 68 between section E and third section 38 and by a longitudinal crease 70 between tab A and the second tab (i.e., tab B). Tab B is further defined by a portion of horizontal cut 66 between section E and section 38 and by a longitudinal crease 72 between tab B and the third tab (i.e., tab C). Tab C is further defined by a portion of horizontal cut 66 between section E and section 38 and by a longitudinal cut 74 between the third tab and the fourth tab (i.e., tab C'). Tab C' is further defined by a portion of horizontal cut 66' between section E and section 38 and longitudinal crease 72' between tab C' and the fifth tab (i.e., tab B'). Tab B' is further defined by a portion of horizontal cut 66' between section E and section 38 and by a longitudinal crease 70' between tab B' and the sixth tab (i.e., tab A'). Tab A' is further defined by a horizontal crease 68' between section E and section 38.

As was explained in greater detail with respect to FIG. 5, first tab A has a first width and second tab B has a second width that is substantially equal to the first width. Likewise, sixth tab A' has a sixth width and fifth tab B' has a fifth width that is substantially equal to the sixth width. In contrast, the widths of tabs C and C' can be substantially equal to the widths of tabs A, B, A', and B', or they can be selected more-or-less arbitrarily or according to the corner protection needs of the object to be packaged.

Figure 6B:
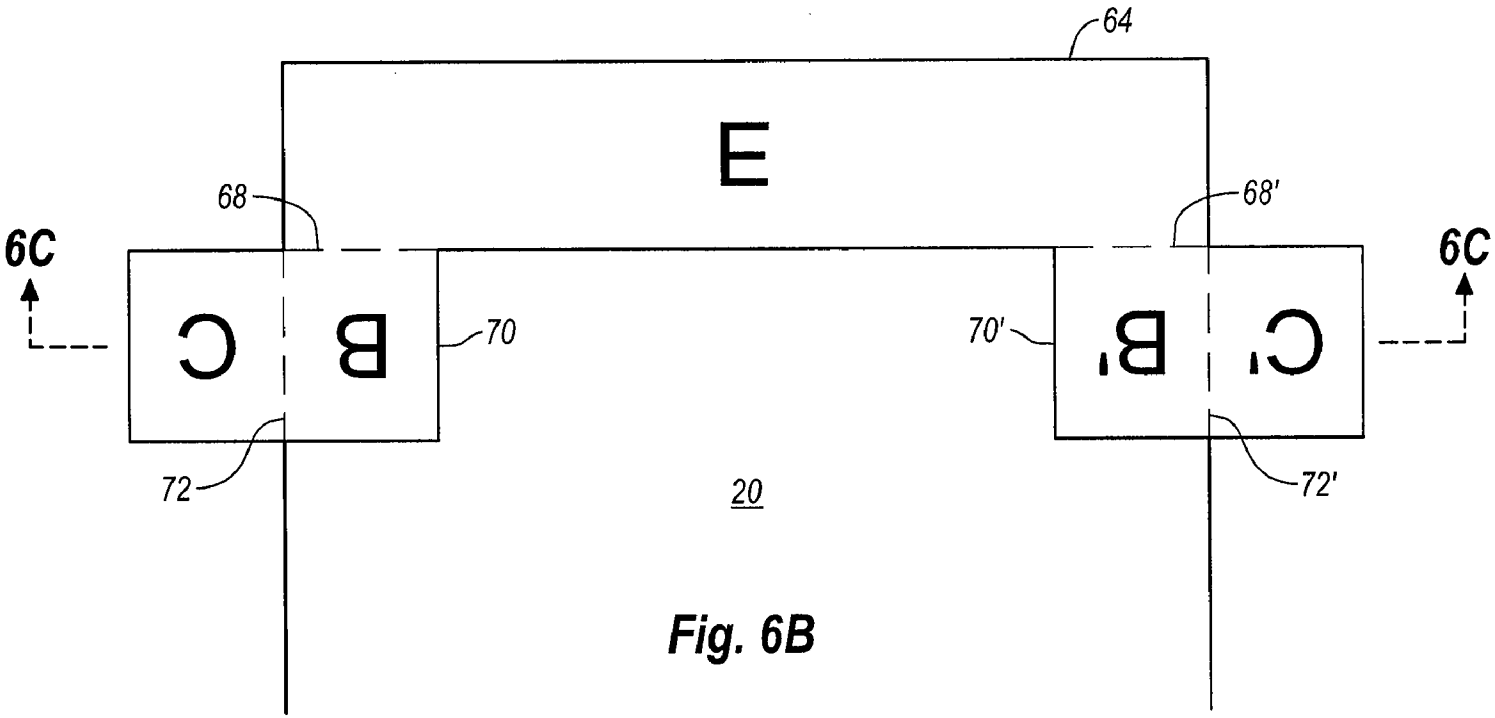
Figure 6C:
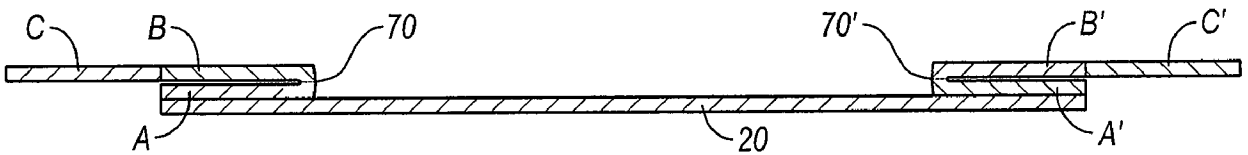
Figure 6D:
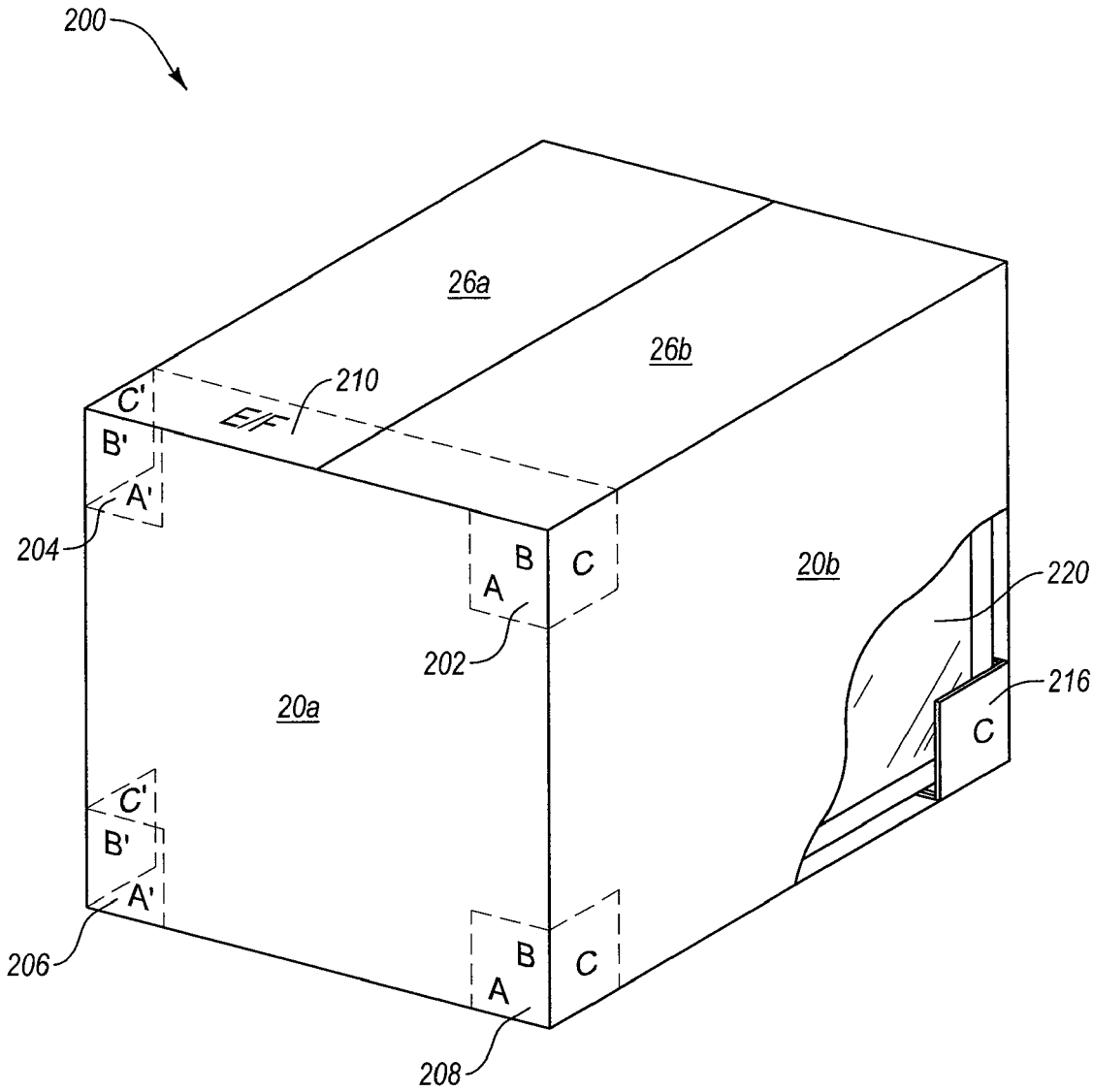

Referring now to FIGS. 6-6D there is shown a similar method for forming a corner protector. With respect to FIG. 6, there is shown two corner protection sections (tabs A-C and tabs A'-C') that extend from section E. The two corner protection sections can be divided along the cut lines and folded along the crease lines to form first and second corner protectors.

Referring now to FIG. 6A, in a first step of forming the first and second corner protectors, section E and section 38 are folded along crease 64 so that section E lies over section F and the crease cut line between section E and section 38 is aligned with crease 62. In a second step illustrated in FIG. 6B, the first corner protector is formed by folding tabs B and C along crease 70 over tab A to form a first stack with tab B lying over tab A and with tab C extending away from the first stack. Likewise, the second corner protector can be formed by folding tabs B' and C' along crease 70' over tab A' to form a second stack with tab B' lying over tab A' and with that tab C' extending away from the second stack. Alternatively, tabs B and C and/or tabs B' and C' can be folded under corresponding tab A and/or tab A' in a manner similar to that illustrated and described in connection with FIGS. 5B and 5C.

Referring now to FIG. 6C, a cut-away view of the corner protector section of FIG. 6B is illustrated. As can be seen in FIG. 6C, tab B is folded over tab A along crease line 70 to form a stack with the tab C extending away from the stack. As such, the first corner protector is formed from three tabs folded in a two-by-one pattern. Likewise, tab B' is folded over tab A' along crease line 70' to form a stack with the tab C' extending away from the stack. As such, the second corner protector is formed from three tabs folded in a two-by-one pattern.

Notably, this folding process enables one or more of the corner protectors to be formed before placing the item to be packaged on the box template and folding the box template around the item to form a package. In particular, once tabs B and B' have been folded over tabs A and A', as shown in FIGS. 6B and 6C, the item to be packaged can be placed on top of the A/B and A'/B' stacks. Tabs C and C' can then be folded up around the side of the item, and the side panels can be folded around the item. It will be understood that folding up the side panels can also cause tabs C and C' to be folded up around the sides of the item.

Referring now to FIG. 6D, a folded box 200 is illustrated showing side panels 20*a* and 20*b* and the first end surface formed from panels 26*a* and 26*b*. The folded box 200 is used to package article 220, which is shown in partial cut-away form. The article 220 is protected in the box by a plurality of corner protectors 202, 204, 206, and 208, which protect the sides of the article 220. The first end side of the article 220 is protected by fold 210, which includes sections E and F of the minor flap. More specifically, once the item has been placed on top of the A/B and A'/B' stacks and tabs C and C' and side panels 20*b*-20*d* are folded around the item, as described above, sections E, and F can be folded (along creases 62 and 64) up around the item before panels 26*a* and 26*b* are folded to close the ends of the box. Once the box is formed as shown in FIG. 6D, straps, tape, or other binding materials can be used to secure the side panels and end panels around the packaged item.

The above described and illustrated manner and process for folding the integrated corner protectors is merely exemplary. The corner protectors of box templates 100 and 200 can be folded and formed in other manners without departing from the scope of the present invention.

The corner protectors as described above provide many advantageous. For instance, the corner protectors are integrally formed with the box template, and thus additional or separate corner protectors are not needed. Furthermore, the corner protectors can be formed out of what are typically referred to as the minor flaps of a box. That is, a box template typically has four side sections, four major flaps, and four minor flaps. The major and minor flaps are commonly used to form the first end and second end of the box. In the present invention, one or more of the minor flaps is used to form the corner protectors described herein. By forming the corner protectors out of one or more of the minor flaps, a box with integrated corner protectors can be formed without using any additional material over what would otherwise be used to form a box of similar type and size. Additionally, the minor flaps of a box typically perform very little, if any function. Thus, by using the minor flaps as corner protectors, the otherwise unutilized material of the box is converted into a useful feature.

Furthermore, the box templates 100 and 200 can be formed with one or more corner protector sections. That is, one or more of sections 24*a*-24*d* or 34*a*-34*d* can be cut/creased to form corner protectors, while the remaining sections of sections 24*a*-24*d* or 34*a*-34*d* can be left uncut/uncreased. The uncut/uncreased sections can be used to form at least a portion of the first end and/or second end of the box, as is done with a typical box. Providing one or more corner protector sections may be desirable when it is only necessary to provide additional protection to some of the corners of an item to be placed in a box. For example, it may be desirable to provide additional protection to the front of a cabinet or an appliance that is packaged within a box, while it is not as necessary to protect the back of the cabinet or appliance. In such a case, a box according to the present invention may be formed with only one or two corner protection sections (e.g., 24*a* and 24*b*) while the other sections (e.g., 24*c* and 24*d*) are used as part of the first end and second end of the box. Thus, a box with integrated corner protectors according to the present invention may be formed with one, two, three, or four corner protector sections.

Another advantageous feature of the present invention is that the corner protectors can be folded prior to placing the item to packaged on the box template and forming the box around the item. Thus, the item can be packaged with the corner protectors already in place. This provides the assurance that the corner protectors are properly positioned around the packaged item. Moreover, referring to the embodiment illustrated in FIGS. 7A and 7B, the corner protectors can be formed and secured in a folded position prior to forming the box around the item to be packaged. This allows a single packager to form the corner protectors and package an item while assuring that the corner protectors are properly positioned around the packaged item.

Additionally, each of the three sides of the box corner protector provides at least one additional layer of protection in addition to the layers typically provided by a box. In particular, the first end side of the box corner has sections E and F, while the sides of the box have tabs A and B on one side and tab C on the other side.

Still further, the material used to form the corner protectors can be formed of or coated with a non-abrasive material. In some embodiments, the box is formed of a corrugated cardboard material that has one surface that is smoother, or has a smoother finished applied thereto. The corner protectors can be folded such that one or more of the three surfaces that are formed by each of the corner protectors and that contact a packaged item are the non-abrasive/smoother surface. This can protect the packaged item from minor scratches that may otherwise be causes from rubbing against a more abrasive, not coated surface.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

We claim:

1. A box template having at least one integrated corner protector, comprising:

a foldable carton having four side surfaces;

an end flap extending from an end of each of the four side surfaces, wherein a horizontal crease separates each end flap from its corresponding side surface, wherein at least one of the end flaps comprises:

a first section integrally formed with a first side surface of the four side surfaces, the first section being partially defined by a crease between the first section and the first side surface;

a second section integrally formed with the first section, the second section being partially defined by a crease between the second section and first section; and a third section integrally formed with the second section, the third section being partially defined by at least two creases and a cut between the third section and the second section, wherein the at least two creases and the cut between the second section and the third section are generally aligned with one another and generally parallel to the creases between the first section and the first side surface and between the first section and the second section, wherein the third section is separated into at least six tabs by a series of longitudinal cuts and creases, wherein the at least six tabs can be folded along the longitudinal creases to form a first corner protector and a second corner protector.

2. The box template of claim 1, wherein the first section is divided from the second section by a first crease portion having a first length, a first cut having a second length, and a second crease portion having a third length.

3. The box template of claim 2, wherein third length is substantially equal to the first length.

4. The box template of claim 1, wherein the first section has a first height, the second section has a second height that is substantially equal to the first height, and the third section has a third height, wherein the third height is the same or different than the first and second heights.

5. The box template of claim 1, wherein the first corner protector includes a first tab, a second tab, and a third tab and the second corner protector includes a fourth tab, a fifth tab, and a sixth tab.

6. The box template of claim 5, wherein each integrated corner protector includes three rectangular tabs folded and stacked into a two-by-one pattern.

7. The box template of claim 5, wherein:

the first and second corner protectors are formed by folding the second section over the first section;

the first corner protector is further formed by folding the second tab under the first tab to form a first stack such that the third tab extends away from the first stack; and the second corner protector is further formed by folding the fifth tab under the sixth tab to form a second stack such that the fourth tab extends away from the second stack.

8. The box template of claim 5, wherein:

the first and second corner protectors are formed by folding the second section over the first section;

the first corner protector is further formed by folding the second tab over the first tab to form a first stack such that the third tab extends away from the first stack; and the second corner protector is further formed by folding the fifth tab over the sixth tab to form a second stack such that the fourth tab extends away from the second stack.

9. The box template of claim 5, wherein:

the first tab has a first width and the second tab has a second width that is substantially equal to the first width;

the third tab has a third width that is substantially equal to or substantially different from the first and second widths;

the sixth tab has a sixth width and the fifth tab has a fifth width that is substantially equal to the sixth width; and the fourth tab has a fourth width that is substantially equal to or substantially different from the sixth and fifth widths.

10. The box template of claim 5, wherein:

the first tab is defined by a horizontal crease between the second section and the third section and by a longitudinal crease between the first tab and the second tab;

the second tab is further defined by a horizontal cut between the second section and the third section and by a longitudinal crease between the second tab and the third tab;

the third tab is further defined by a horizontal cut between the second section and the third section and by at least one longitudinal cut between the third tab and the fourth tab;

the fourth tab is further defined by a horizontal cut between the second section and the third section and by a longitudinal crease between the fourth tab and the fifth tab;

the fifth tab is further defined by a horizontal cut between the second section and the third section and by a longitudinal crease between the fifth tab and the sixth tab; and the sixth tab is further defined by a horizontal crease between the second section and the third section.

11. The box template of claim 5, wherein the third section further includes a seventh tab, wherein the seventh tab is disposed between the third tab and the fourth tab.

12. The box template of claim 11, wherein the seventh tab is defined by longitudinal cuts between the third and fourth tabs and a horizontal crease between the second section and the third section.

13. The box template of claim 12, wherein the crease between the first section and the first side surface includes a cut configured for positioning the seventh tab therethrough.

14. The box template of claim 13, wherein:

the first and second corner protectors are formed by folding the second section over the first section;

the first corner protector is further formed by folding the second tab under the first tab to form a first stack such that the third tab extends away from the first stack;

the second corner protector is further formed by folding the fifth tab under the sixth tab to form a second stack such that the fourth tab extends away from the second stack; and positioning the seventh tab through cut portion so as to secure the first and second corner protectors in a folded position.

15. The box template of claim 1, wherein the foldable carton includes a first end surface formed from two major flaps and a second end surface formed from two additional major flaps.

16. The box template of claim 1, wherein the foldable carton includes eight corner protectors.

17. A foldable box, comprising:

at least four side surfaces;

a first end surface formed from two major flaps integrally formed with two of the at least four side surfaces;

a second end surface formed from two additional major flaps integrally formed with two of the at least four side surfaces; and at least one minor flap integrally formed with at least one of the at least four side surfaces, wherein the at least one minor flap includes a plurality of cuts and creases configured to enable the at least one minor flap to be folded into at least one corner protector to provide protection to an item placed inside the foldable box, wherein the plurality of cuts and creases defines a first section integrally formed with the at least one of the at least four side surfaces, a second section integrally formed with the first section and spaced apart from the at least one of the at least four side surfaces, and a third section integrally formed with the second section and spaced apart from the first section, wherein the plurality of cuts and creases defines at least six rectangular tabs that are substantially aligned with one another along a width of the at least one of the at least four side surfaces.

18. The foldable box of claim 17, wherein the two major flaps and the two additional major flaps are integrally form with a first side surface and a second side surface, respectively, of the at least four side surfaces, and wherein the at least one minor flap is integrally formed with a third side surface of the at least four side surfaces.

19. The foldable box of claim 17, wherein the at least one minor flap comprises four minor flaps configured to form eight corner protectors.

20. The foldable box of claim 17, wherein the six rectangular tabs form a first groups of three rectangular tabs and a second group of three rectangular tabs, wherein the three rectangular tabs of each of the first and second groups are adapted to be folded and stacked into a two-by-one pattern to form a corner protector.

21. The foldable box of claim 17, wherein the at least one corner protector is formed from three tabs, wherein each of the three tabs defines a corner protector configured to protect a corner that extends from a first side to a second side of the foldable box.

22. The foldable box of claim 17, wherein the at least one minor flap is configured to form a left corner protector and a right corner protector, wherein:

the left corner protector includes a first tab, a second tab, and a third tab, with the left corner protector being formed by folding the second tab under the first tab to form a first stack such that the third tab extends away from the first stack; and the right corner protector includes a fourth tab, a fifth tab, and a sixth tab, with the right corner protector being formed by folding the fifth tab under the sixth tab to form a second stack such that the fourth tab extends away from the second stack.

23. The foldable box of claim 22, wherein the left corner protector and the right corner protector are integrally connected to a respective side surface by a lateral portion.

24. The foldable box of claim 22, wherein the first and sixth tabs are separated from the lateral portion by a crease line, and wherein the second, third, fourth, and fifth tabs are separated from the lateral portion by a cut.

25. A box template that is configured to be folded into a box, the box template having a plurality of identifiable sections that are arranged in first, second, third, and fourth columns, wherein:

the first column of the box template includes a first side panel configured to form a first side of the box and first and second minor flaps integrally formed with and extending from opposite ends of the first side panel, wherein each of the first and second minor flaps is configured to form a pair of corner protectors, wherein each of the first and second minor flaps comprises a plurality of cuts and creases to form a series of tabs configured to be folded to form the pair of corner protectors;

the second column of the box template includes a second side panel configured to form a second side of the box and first and second major flaps integrally formed with and extending from opposite ends of the second side panel, wherein each of the first and second major flaps are configured to form a first end surface that is configured to be folded to form at least a portion of a first end of the box and a second end surface that is configured to be folded to form at least a portion of a second end of the box, the third column of the box template including a third side panel configured to form a third side of the box and third and fourth minor flaps integrally formed with and extending from opposite ends of the third side panel, wherein each of the third and fourth minor flaps is configured to form a pair of corner protectors, wherein each of the third and fourth minor flaps comprises a plurality of cuts and creases to form a series of tabs configured to be folded to form the pair of corner protectors; and the fourth column of the box template including a fourth side panel configured to form a fourth side of the box and third and fourth major flaps integrally formed with and extending from opposite ends of the fourth side panel, wherein the third major flap is configured to form a second first end surface that is configured to be folded to form at least a portion of the first end of the box and a second second end surface that is configured to be folded to form at least a portion of the second end of the box, wherein each of the minor flaps is divided into a first section, a second section, and a third section by a series of horizontal cuts and creases, with the third section being further divided by a series of longitudinal cuts and creases to form a first set of three tabs configured to form a first corner protector and a second set of three tabs configured to form a second corner protector.

26. The box template of claim 25, wherein the third section further includes a seventh tab disposed between the first set of three tabs and the second set of three tabs.

27. The box template of claim 26, wherein the seventh tab can be at least partially received through a cut formed between the side panel and the first section of the minor flap so as to secure each of the corner protectors in a folded position.

* * * * *